US009134096B2

(12) United States Patent
de Haas et al.

(10) Patent No.: US 9,134,096 B2
(45) Date of Patent: Sep. 15, 2015

(54) BALLISTIC RESISTANT ARTICLE COMPRISING A STYRENE BUTADIENE RESIN AND PROCESS TO MANUFACTURE SAID ARTICLE

(75) Inventors: Marc-Jan de Haas, Apeldoorn (NL); Alex van Norel, Duiven (NL); Vincent van Bommel, Zevenaar (NL); Ramon van Rooij, Huissen (NL); Nicolas Cunningham, Brampton (CA); Chinkalben Patel, Ancaster (CA)

(73) Assignees: Teijin Aramid B.V. (NL); Barrday, Inc. (CA)

( * ) Notice: Subject to any disclaimer, the term of this patent is extended or adjusted under 35 U.S.C. 154(b) by 2 days.

(21) Appl. No.: 13/979,664

(22) PCT Filed: Jan. 18, 2012

(86) PCT No.: PCT/EP2012/050701

§ 371 (c)(1),
(2), (4) Date: Jul. 15, 2013

(87) PCT Pub. No.: WO2012/098154

PCT Pub. Date: Jul. 26, 2012

(65) Prior Publication Data

US 2013/0295805 A1 Nov. 7, 2013

Related U.S. Application Data

(60) Provisional application No. 61/433,778, filed on Jan. 18, 2011.

(30) Foreign Application Priority Data

Jan. 18, 2011 (EP) ..... 11151239

(51) Int. Cl.
*F41H 1/02* (2006.01)
*F41H 5/04* (2006.01)

(52) U.S. Cl.
CPC ..... *F41H 1/02* (2013.01); *F41H 5/0435* (2013.01); *F41H 5/0464* (2013.01); *F41H 5/0485* (2013.01); *Y10T 442/10* (2015.04); *Y10T 442/2623* (2015.04)

(58) Field of Classification Search
CPC ..... F41H 1/02; F41H 5/0435; F41H 5/0464; F41H 5/0485; Y10T 442/2623; Y10T 442/10
USPC ..... 2/2.5; 89/36.01, 36.02, 36.04, 36.05; 156/309.3; 428/102, 103, 104, 105, 428/107, 108, 109, 110, 111, 112, 114, 220, 428/911; 442/1, 43, 49, 134, 135, 181, 184, 442/189, 239, 246–255, 260, 261, 280
See application file for complete search history.

(56) References Cited

U.S. PATENT DOCUMENTS

| | | | | |
|---|---|---|---|---|
| 4,683,172 | A | 7/1987 | Legrand | |
| 5,753,362 | A * | 5/1998 | Kawase et al. | 428/327 |
| 6,893,704 | B1 | 5/2005 | van der Loo | |
| 8,017,530 | B1 * | 9/2011 | Ardiff et al. | 442/134 |
| 2006/0135022 | A1 * | 6/2006 | Porter | 442/381 |
| 2011/0203449 | A1 * | 8/2011 | Ardiff et al. | 89/36.02 |

FOREIGN PATENT DOCUMENTS

| | | |
|---|---|---|
| EP | 0169432 | 1/1986 |
| WO | 2008140567 | 11/2008 |

OTHER PUBLICATIONS

Honeywell International Inc. "Honeywell spectra fiber 1000" product information sheet. Retrieved Jun. 24, 2011 from URL: www5l.honeywell.com/sm/afc/common/documents/PP_APC_Honeywell_spectra_fiber_1000_Product_information_sheet.pdf.

International Search Report for PCT Application No. PCT/EP2012/050701 completed Mar. 20, 2012.

* cited by examiner

*Primary Examiner* — Arti Singh-Pandey
(74) *Attorney, Agent, or Firm* — Carlson, Gaskey & Olds, P.C.

(57) ABSTRACT

A ballistic resistant article is presented comprising a plurality of fibrous layers, each of said layers comprising a network of fibers, wherein the fibers have a strength of at least 800 mN/tex (1100 MPa) according to ASTM D 7269-07 and a matrix material, wherein the matrix material comprises a mixture comprising: at least one styrene butadiene random copolymer resin, and at least one tackifier. Compared with an article of the same construction but with a matrix material without a tackifier the article according to the invention comprises a higher adhesion between the fibrous layers both in the unaged and aged state and a lower water pick up after water soak. The article additionally comprising a plate of metal or ceramic exhibits minimal or even no delamination of the fibrous layers after ballistic attack. In contrast an article of the same construction but with a matrix material without the styrene butadiene random copolymer resin exhibits (very strong) interior delamination of the fibrous layers and the article of the same construction with the styrene butadiene random copolymer resin, but without the tackifier as the matrix material exhibits light delamination.

18 Claims, No Drawings

BALLISTIC RESISTANT ARTICLE COMPRISING A STYRENE BUTADIENE RESIN AND PROCESS TO MANUFACTURE SAID ARTICLE

BACKGROUND OF THE INVENTION

The present invention pertains to a ballistic resistant article and to a process to manufacture said article.

WO 2008/077605 describes a ballistic resistant sheet comprising a stack of at least 4 monolayers, each monolayer containing unidirectionally oriented reinforcing fibers with a tensile strength of between 3.5 and 4.6 GPa, the fiber direction in each monolayer being rotated with respect to the fiber direction in an adjacent monolayer, an areal density of a monolayer of at least 25 g/m$^2$ and at most 20 mass % of a matrix material preferably selected from the group of polyurethanes, polyvinyls, polyacrylics, polyolefines, polyisoprene-polyethylene-butylene-polystyrene block copolymers or polystryrene-polyisoprene-polystyrene block copolymers. The latter block copolymer is used in the example of WO 2008/077605 and therefore, especially preferred.

However, there is a demand for ballistic resistant sheets with a higher adhesion between the monolayers not only in the unaged state of the ballistic resistant sheet but also after aging the sheet in a climate at elevated values of temperature and relative humidity and/or in a chemically degrading atmosphere, e.g. in an oxygen atmosphere.

Furthermore, there is a demand for ballistic resistant sheets with lower water pick up after water soak.

Finally, if the ballistic sheet is joined to a plate of metal or ceramic, there is a demand for a higher structural integrity of the monolayers behind the plate after a ballistic attack from the plate side. So, there is a demand for a lower degree of delamination between the monolayers behind the plate after a ballistic attack.

SUMMARY

Said problems are solved by a ballistic resistant article comprising a plurality of fibrous layers, each of said layers comprising a network of fibers, wherein the fibers have a strength of at least 800 mN/tex (1100 MPa) according to ASTM D 7269-07 and a matrix material, wherein the matrix material comprises, preferably consists of a mixture comprising at least one styrene butadiene random copolymer resin, and at least one tackifier.

Surprisingly, the ballistic resistant article according to the present invention exhibits a considerably higher adhesion between the monolayers not only in the unaged state of the article but also after long-term aging the article in a climate at elevated values of temperature and relative humidity and/or in a chemically degrading atmosphere, e.g. in an oxygen atmosphere in comparison to a ballistic article of the same construction but with a matrix material without a tackifier.

Furthermore, surprisingly the ballistic resistant article according to the present invention exhibits a considerably lower water pickup after water soak in comparison to a ballistic article of the same construction but with a matrix material without a tackifier.

Finally, if according to a preferred embodiment of the ballistic resistant article of the present invention the plurality of fibrous layers is formed into a panel and the panel is joined to a plate of metal or ceramic resulting in a hard-ballistic article, minimal or even no delamination of the fibrous layers is observed after ballistic attack, whereas an article of the same construction but with a matrix material without a tackifier exhibits a higher degree of delamination of the fibrous layers. So, the ballistic resistant article according to the present invention exhibits a higher structural integrity between the fibrous layers in comparison to a ballistic article of the same construction but with a matrix without a tackifier. The surprisingly high structural integrity of the fibrous layers in the ballistic resistant article according to the present invention can be achieved in preferred embodiments of the inventive article together with an antiballistic capability of the inventive article measured as v50-values which both in the unaged and in the aged state, i.e. after long-term aging of the inventive article at elevated values of temperature and relative humidity are very similar or even identical compared to the respective v50-values of an article of the same construction but with a matrix material without a tackifier. As mentioned above the ballistic resistant article according to the present invention comprising a plate of metal or ceramic exhibits minimal or even no delamination of the fibrous layers after ballistic attack. In contrast an article of the same construction but with a matrix material without the styrene butadiene random copolymer resin exhibits (very strong) interior delamination of the fibrous layers and the article of the same construction with the styrene butadiene random copolymer resin, but without the tackifier as the matrix material exhibits light delamination.

Within the scope of the present invention the term "fibrous layers" means layers, which comprise fibers as one of its constituents.

Within the scope of the present invention the term "fibers" means an elongate body, the length dimension of which is much greater than the transverse dimensions of width and thickness. Accordingly, "fibers" includes monofilament fibers, multifilament fibers, ribbons, strips, staple fibers and yarns made from one or more of the foregoing. Especially preferred "fibers" mean multifilament yarns. The cross-sections of the "fibers" to be used in the present invention may vary widely. They may be circular, flat or oblong in cross-section. They also may be of irregular or regular shape having one or more regular or irregular lobes projecting from the longitudinal axis of e.g. a filament. Preferably the "fibers" exhibit a substantially circular cross-section.

Within the scope of the present invention the term "a plurality of fibrous layers" means at least two fibrous layers. However, depending on the intensity of the ballistic attack the ballistic resistant article of the present invention has to withstand, the number of fibrous layers constituting the plurality of fibrous layers can be selected by those skilled in the art and knowing the present invention. For a lot of ballistic attack situations a number of fibrous layers preferably ranging from 2 to 250 and more preferably ranging from 10 to 100 is sufficient.

Within the scope of the present invention the term "a network of fibers" means a plurality of fibers arranged into a predetermined configuration or a plurality of fibers grouped together to from a twisted or untwisted yarn, which yarns are arranged into a predetermined configuration. The fiber network can have various configurations. For example, the fibers or yarns may be formed as a felt or other nonwoven, knitted or woven into a network, or formed into a network by any conventional techniques.

According to a particularly preferred network configuration the network of fibers is a unidirectional alignment of the fibers, i.e. the fibers are unidirectionally aligned so that they are substantially parallel to each other along a common fiber direction.

Fibers useful to form the network of fibers in the ballistic resistant article according to the present invention are those having a strength of at least 1100 MPa according to ASTM D 7269-07. Among said fibers aramid fibers are preferred. Within the scope of the present invention the term "aramid fibers" means fibers produced from an aromatic polyamide as the fiber-forming polymer. In said fiber forming polymer at least 85% of the amide (—CO—NH—) bonds are directly bound on two aromatic rings. Especially preferred aromatic polyamides are p-aramides. Among the p-aramides poly(p-phenylene terephthalamide) is the most preferred one. Poly (p-phenylene terephthalamide) results from the mol:mol polymerization of p-phenylene diamine and terephthalic acid dichloride. Fibers consisting e.g. of multifilament yarns made from poly(p-phenylene terephthalamide) can be obtained under the trade name Twaron® from Teijin Aramid (NL).

Further aramid fibers useful to form the network of fibers in the ballistic resistant article according to the present invention are those formed from an aromatic copolymer as the fiber-forming polymer. In the said aromatic copolymer p-phenylene diamine and/or terephthalic acid dichloride are partly or completely substituted by other aromatic diamines and/or dicarboxylic acid chlorides.

Within the scope of the present invention the term "matrix material" means a material, which in particular bonds fibers within a single fibrous layer to one another and thereby stabilizes the single fibrous layer.

The matrix material of the ballistic resistant article according to the present invention exhibits a matrix material, wherein the matrix material comprises a mixture comprising at least one styrene butadiene random copolymer resin, i.e. a copolymer, wherein the copolymerization parameters of styrene and butadiene determine a random sequence of styrene and butadiene in the copolymer chain, and at least one tackifier.

Additionally said mixture may comprise formulation auxiliaries used by the manufacturers of the styrene butadiene random copolymer resin and of the tackifier. For example, the at least one styrene butadiene random copolymer resin and/or the at least one tackifier may comprise one or more surfactants. Furthermore, the at least one styrene butadiene random copolymer resin and/or the at least one tackifier may comprise small quantities of a wetting agent, defoaming agent, antioxidants, UV stabilizers and free radical scavengers.

In a preferred embodiment of the ballistic resistant article according to the present invention the styrene butadiene random copolymer resin is a carboxylated styrene butadiene random copolymer resin. In said preferred embodiment the mixture being comprised of the matrix material of the inventive ballistic resistant article contains at least one carboxylated styrene butadiene random copolymer resin.

DETAILED DESCRIPTION

Within the scope of the present invention the term "at least one carboxylated styrene butadiene random copolymer resin" means at least one copolymer which has been synthesized by copolymerizing the monomers styrene, butadiene and optionally a third monomer, wherein a low part to be quantified below of either the styrene and/or the butadiene and/or the third monomer contains at least one carboxylic group. So, the term "at least one carboxylated styrene random copolymer butadiene resin" comprises several preferred embodiments, which are described in the following.

In a first preferred embodiment the resin is a copolymer, which has been synthesized by copolymerizing the monomers styrene and butadiene, wherein a low part of the styrene contains at least one carboxylic group.

In a second preferred embodiment the resin is a copolymer, which has been synthesized by copolymerizing the monomers styrene and butadiene, wherein a low part of the butadiene contains at least one carboxylic group.

In a third preferred embodiment the resin is a copolymer, which has been synthesized by copolymerizing the monomers styrene and butadiene, wherein a low part of both styrene and the butadiene contain at least one carboxylic group.

In a fourth preferred embodiment the resin is a copolymer, which has been synthesized by copolymerizing the monomers styrene and butadiene and a third monomer, wherein a low part of the third monomer contains at least one carboxylic group. The third monomer is selected from the group consisting of ethylenically unsaturated carboxylic acids. The selected ethylenically unsaturated carboxylic acid may be a monocarboxylic acid or a polycarboxylic acid or a mixture of such acids. Preferably the acid has 2 to 10 chain carbon atoms, i.e. C-atoms forming a C2-10 chain, which contains the ethylenical unsaturation. The carbon atom of the carboxylic acid is not included in said 2 to 10 chain carbon atoms. Examples of preferred monocarboxylic acids are acrylic acid, methacrylic acid and crotonic acid. Examples of polycarboxylic acids are maleic acid, fumaric acid, itaconic acid and 3-butene 1,2,3-tricarboxylic acid.

In a fifth preferred embodiment the resin is a copolymer, which has been synthesized by copolymerizing the monomers styrene and butadiene and a third monomer, wherein a low part of both styrene and the third monomer contain at least one carboxylic group.

In a sixth preferred embodiment the resin is a copolymer, which has been synthesized by copolymerizing the monomers styrene and butadiene and a third monomer, wherein a low part of both the butadiene and the third monomer contain at least one carboxylic group.

In a seventh preferred embodiment the resin is a copolymer, which has been synthesized by copolymerizing the monomers styrene and butadiene and a third monomer, wherein a low part of the styrene, the butadiene and the third monomer contain at least one carboxylic group.

In an eighth preferred embodiment the at least one carboxylated styrene butadiene resin is a mixture of at least one copolymer belonging to the first, second or third embodiment and at least one copolymer belonging to the fourth, fifth, sixth and seventh embodiment.

In each of the preferred embodiments described above the term "carboxylic group" means a carboxylic acid group, which is present either in the neutral form —COOH or in the anionic form which can occur as $—COO_- H_+$ or as a salt $—COO_- M_+$, wherein $M_+$ is a metal cation.

As indicated before, in all embodiments of the at least one carboxylated styrene butadiene random copolymer resin the weight percentage (wt. %) of the monomer bearing the at least one carboxylic group with respect to the respective copolymer is generally low and for example is between 0.05 wt. % and 10 wt. % and may be in the range from 5 wt. % or less down to 0.05 wt. %. Or the weight percentage may be in the range from 1 wt. % or less to ≥0.05 wt. %.

In all embodiments of the at least one carboxylated styrene butadiene random copolymer resin the carboxylation level, cl, which is calculated using the dry weight of carboxylic acid (COOH)-groups in the carboxylated styrene butadiene random copolymer, wCOOH, and the dry weight of the monomers in the carboxylated styrene butadiene random copolymer resin, wmonomer, by the formula cl=(wCOOH/ wmonomer)·100(%) is preferably in the range from 0.05% to 15.0%, more preferably in the range from 0.05% to 10.0% and most preferred in the range from 0.05% to 5.0%.

In all embodiments of the at least one carboxylated styrene butadiene copolymer resin said copolymer is a random copolymer, i.e. a polymer wherein the sequence of the styrene, the butadiene and of the optional third monomer is a statistical sequence defined by the copolymerisation parameters of the respective bi- or tercopolymerisation.

In a further preferred embodiment of the ballistic resistant article according to the present invention the styrene butadiene random copolymer resin is a non-carboxylated styrene butadiene random copolymer resin, i.e. a styrene butadiene random copolymer resin, which does not contain any carboxylic groups.

The at least one styrene butadiene random copolymer resin which—beside the at least one tackifier—is used to manufacture the matrix material of the ballistic resistant article of the present invention and which may be a carboxylated or a non-carboxylated styrene butadiene random copolymer resin exhibits a glass transition temperature Tg which preferably is in the range between −70° C. and 100° C., more preferred in the range between −50° C. and 30° C., and most preferred in the range between −30° C. and 20° C.

Within the scope of the present invention the term "at least one tackifier" means at least one chemical compound present in the matrix material of the ballistic resistant article and being homogenously distributed in said matrix material, thereby providing the matrix material with tack. And within the scope of the present invention the term "homogeneously distributed in said matrix material" means that the concentration of the at least one tackifier in every volume element of the matrix material is the same.

In a preferred embodiment of the ballistic resistant article according to the present invention the tackifier is selected from the group consisting of

- rosin resins which are derived from either tree stumps (wood resin), sap (gum rosin) or by-products of the paper making process (tall oil rosin),
- wherein the rosin resins may be
- rosin esters obtained by the reaction between rosin acids and alcohols,
- hydrogenated rosin esters obtained by hydrogenation of the rosin acid raw material or
- dimerized rosin resins obtained from dimerizing rosin acids or
- terpene resins derived from terpene feedstocks either from wood sources or from citrus fruit, or
- hydrocarbon resins available from Neville Chemical Company, US under several designations, such as NP-10, NP-25 and FN-175.

In a preferred embodiment of the ballistic resistant article according to the present invention the tackifier is present in the matrix material in a weight percentage with respect to the weight of matrix material resin ranging from 1 wt. % to 20 wt. %, more preferred from 1.5 wt. % to 10 wt. % and most preferred from 2 wt. % to 6 wt. %. If said weight percentage of the tackifier is below 1 wt. % handling of the single fibrous layer during the manufacture of the ballistic resistant article of the present invention may become more complicated. For example, if a fibrous layers comprises a unidirectional alignment of fibers, said alignment may become instable within the single layer. If said weight percentage of the tackifier is above 20 wt. %, the ballistic article may become too stiff and the advantage of the carboxylated styrene butadiene random copolymer resin are lost.

The mixture of

- the at least one styrene butadiene random copolymer resin, which may be a carboxylated or a non-carboxylated styrene butadiene random copolymer resin and the at least one tackifier, which is used to manufacture the matrix material of the ballistic resistant article of the present invention can be applied in the form of an emulsion or in the form of a dispersion, e.g. as a latex dispersion. The medium of the emulsion or dispersion may be an organic medium or preferably is a waterborne medium.

If the mixture of

- the at least one carboxylated styrene butadiene random copolymer resin, which may be a carboxylated or a non-carboxylated styrene butadiene random copolymer resin and
- the at least one tackifier is used in the form of an emulsion, the emulsion may have been prepared by using an emulsifying agent selected from anionic, cationic, non-ionic, fatty acids or rosin acid soap as an emulsifying agent.

In preparing said mixture the following mixing sequence is preferably practiced:

Step 1: A styrene butadiene random copolymer resin, which may be a carboxylated or a non-carboxylated styrene butadiene random copolymer resin, is provided, e.g. as an emulsion.

Step 2: Optionally another styrene butadiene random copolymer, which may be a carboxylated or a non-carboxylated styrene butadiene random copolymer resin, e.g. as an emulsion, is blended with the styrene butadiene random copolymer resin of step 1.

Step 3: At least one tackifying agent, e.g. as a waterborne dispersion or emulsion, is added to the styrene butadiene random copolymer resin(s) of step 2 with stirring.

Step 4: Optionally at least one crosslinking agent is added to the [carboxylated or non-carboxylated styrene butadiene random copolymer resin(s)/tackifier(s)]-mixture.

The at least one styrene butadiene random copolymer resin, which may be a carboxylated or a non-carboxylated styrene butadiene random copolymer resin, and the at least one tackifier, e.g. the emulsion or dispersion containing the said least one styrene butadiene random copolymer resin and the at least one tackifier, may comprise a cross-linking agent that in the optional presence of a carboxylated styrene butadiene random copolymer resin can react with the carboxylic acid such as an amino resin, a methylated melamine, a melamine formaldehyd resin or a dihydrazide. If the at least one carboxylated styrene butadiene random copolymer resin and the at least one tackifier are applied in the form of a waterborne dispersion, e.g. the cross-linking agent Cymel® 385 available from Cytec (Woodland Park, N.J., USA) can be used.

From the above it becomes apparent that in a preferred embodiment of the present invention, wherein a cross-linking agent has been applied during the manufacture of the ballistic resistant article according to the present invention, that part of the carboxylic groups of the carboxylated styrene butadiene random copolymer resin which was involved in a cross-linking reaction is no longer present as —COOH, or as —$COO_-$ $H_+$ or as —$COO_-$ $M_+$, but in a chemically modified form depending from the cross-linking agent. If, for example, an amide is used as the cross-linking agent, those carboxylic groups, which took part in the cross-linking reaction, are transferred into amide groups. The amount of cross-linking depends on the type of cross-linking agent, its concentration and on the values of temperature, pressure and time applied during the manufacture of the ballistic resistant article according to the present invention.

In a further preferred embodiment of the ballistic resistant article according to the present invention even without the presence of an additional cross-linking agent during the manufacture of said article cross-linking may occur by the reaction of at least one carboxylic group of at least one polymer chain of the carboxylated styrene butadiene random copolymer resin with at least one carboxylic groups of an adjacent polymer chain of the carboxylated styrene butadiene random copolymer resin. In this case the cross-linking may occur by forming anhydrid-bridges between adjacent chains of the carboxylated styrene butadiene resin.

Furthermore, the emulsion or dispersion of the at least one styrene butadiene random copolymer resin, which may be a carboxylated or a non-carboxylated styrene butadiene random copolymer resin, and the at least one tackifier may comprise small quantities of a wetting agent, defoaming agent, antioxidants, UV stabilizers and free radical scavengers.

In a further embodiment of the ballistic resistant article according to the present invention the matrix material may comprise a first styrene butadiene random copolymer resin, which may be a carboxylated or a non-carboxylated styrene butadiene random copolymer resin having a first glass transition temperature, Tg(1st), and a second styrene butadiene random copolymer resin, which may be a carboxylated or a non-carboxylated styrene butadiene random copolymer resin having a second glass transition temperature, Tg(2nd), wherein Tg(1st)>Tg(2nd). In this case Tg(1st) may be in a range, which is preferably from −10° C. to 50° C., more preferable in the range from 0° C. to 40° C., and most preferable in a range from 10° C. to 30° C., and Tg(2nd) may be in a range, which is preferably from −50° C. to −10° C., more preferable in the range from −40° C. to −10° C., and most preferable in a range from −30° C. to −20° C.

In an especially preferred embodiment of the ballistic resistant article of the present invention the first styrene butadiene random copolymer resin, which may be a carboxylated or a non-carboxylated styrene butadiene random copolymer resin, has Tg(1st)>0 and the second styrene butadiene random copolymer resin, which may be a carboxylated or a non-carboxylated styrene butadiene random copolymer resin, has Tg(2nd)<0.

In a further especially preferred embodiment of the ballistic resistant article of the present invention the first styrene butadiene random copolymer resin, which may be a carboxylated or a non-carboxylated styrene butadiene random copolymer resin, has Tg(1st)<0 and the second styrene butadiene random copolymer resin, which may be a carboxylated or a non-carboxylated styrene butadiene random copolymer resin, has Tg(2nd)<0.

In a further especially preferred embodiment of the ballistic resistant article of the present invention the first styrene butadiene random copolymer resin, which may be a carboxylated or a non-carboxylated styrene butadiene random copolymer resin, has Tg(1st)>0 and the second styrene butadiene random copolymer resin, which may be a carboxylated or a non-carboxylated styrene butadiene random copolymer resin, has Tg(2nd)>0.

In a further embodiment of the ballistic resistant article according to the present invention the matrix material comprises the at least one carboxylated styrene butadiene random copolymer resin and additionally at least one non-carboxylated styrene butadiene random copolymer resin, i.e. a resin which does not contain any carboxylic groups. For example, additionally two non-carboxylated styrene butadiene resins may be comprised by the matrix material.

In preferred embodiments of the ballistic resistant article according to the present invention, wherein additionally at least one non-carboxylated styrene butadiene random copolymer resin is present, said at least one non-carboxylated styrene butadiene random copolymer resin may be present in the matrix material as a mixture with the at least one carboxylated styrene butadiene random copolymer resin and the at least one tackifier in the matrix of every fibrous layer A of said article resulting in a sequence of fibrous layers (A)n with n being the total number of fibrous layers.

Alternatively, the at least one non-carboxylated styrene butadiene random copolymer resin may constitute the entire matrix of a fibrous layer B, whereas the adjacent fibrous layer C does not contain any non-carboxylated styrene butadiene random copolymer resin in their matrix material but consists of the at least one carboxylated styrene butadiene random copolymer and the at least one tackifier. In said optional alternative embodiment the ballistic resistant according to the present invention comprises a sequence of fibrous layers (BC)n with n being the total number of fibrous layers.

In a further embodiment of the ballistic resistant article according to the present invention the matrix material comprises the at least one carboxylated styrene butadiene random copolymer resin and additionally an anionic carboxylated butadiene random copolymer resin.

Carboxylated styrene butadiene random copolymer resins are available e.g. from Mallard Creek (USA) under the trade name Rovene® and Polymer Latex (Germany) under the trade names Litex® and Lipaton®.

In the ballistic resistant article according to the present invention the fibers have a weight wf, the matrix material has a weight wm and a weight percentage of the matrix material with respect to (wf+wm) preferably is from 5 wt. % to 50 wt. %, more preferably from 10 wt. % to 30 wt. % and most preferably from 12 wt. % to 20 wt. %.

In a further preferred embodiment of the ballistic resistant article according to the present invention the areal density of the fibers in a single fibrous layer ranges from 10 g/m$^2$ to 250 g/m$^2$, more preferable from 60 g/m$^2$ to 200 g/m$^2$ and most preferably from 100 g/m$^2$ to 160 g/m$^2$.

In a further preferred embodiment of the ballistic resistant article according to the present invention the total areal density of a single fibrous layer ranges from 11 g/m$^2$ to 350 g/m$^2$, more preferable from 60 g/m$^2$ to 280 g/m$^2$ and most preferably from 111 g/m$^2$ to 230 g/m$^2$.

In a further preferred embodiment of the ballistic resistant article according to the present invention the plurality of fibrous layers is formed into a panel and the panel is jointed to a plate of metal or ceramic resulting in a hard-ballistic article which exhibits the advantageous properties described before. However, the advantageous properties of the ballistic resistant article according to the present invention can also be seen, if a panel formed of a plurality of fibrous layers without having been joined to a plate of metal or ceramic is subjected to a ballistic attack: A high degree of structural integrity ranging from no or very light bulging to light bulging with some delamination is observed in said panel.

In a further preferred embodiment of the ballistic resistant article according to the present invention a scrim comprising, preferably consisting of a thermoplastic material is situated between the fibrous layers.

In a first preferred alternative the scrim is a mesh, wherein the percentage of the area of the mesh openings with respect to the total area of the scrim is in the range of 40% to 98%, more preferably in the range of 65 to 90% and most preferred in the range of 75 to 85%. Preferably the thermoplastic polymer constituting the scrim is a polyolefine, a copolyamide or a polyurethane. Preferably the scrim has an areal density in the range of 1 g/m$^2$ to 20 g/m$^2$, more preferably in the range of 1 g/m$^2$ 10 to g/m$^2$ and most preferred in the range of 2 g/m$^2$ to 6 g/m$^2$.

In a second preferred alternative the scrim is a fleece consisting of a thermoplastic material, which is preferably a thermoplastic polymer, e.g. a polyolefine, a copolyamide or a polyurethane.

In said preferred embodiments of the ballistic resistant article of the present invention containing a scrim between the fibrous layers the amount of the at least one tackifier can be reduced for example to an extent, that the adhesion between adjacent fibrous layers is the same as without a scrim.

In a further preferred embodiment of the ballistic resistant article according to the present invention the matrix material additionally to the at least one styrene butadiene random copolymer resin, which may be a carboxylated or a non-carboxylated styrene butadiene random copolymer resin, and the at least one tackifier may comprise at least one self-crosslinking acrylic resin with or without at least one tackifier and/or at least one crosslinkable acrylic resin with or without at least one tackifier.

A process to manufacture a ballistic resistant article according to the present invention shall be explained for a preferred embodiment, wherein each fibrous layer of the plurality of fibrous layers consists of a network of fibers, which is a unidirectional alignment of yarns. In this case the process at least comprises the steps (1)-(3) described in the following. With the aid of said description those skilled in the art will be able to transfer the process to manufacture a ballistic resistant article according to the present invention to include networks of fibers other than unidirectional alignments of yarn, e.g. felts or other nonwoven fabrics and knitted or woven fabrics.

(1) Manufacture of a single unidirectional fibrous layer: Yarns having a strength of at least 800 mN/tex (1100 MPa) according to ASTM D 7269 are unidirectionally aligned so that they are substantially parallel to each other along a common fiber direction. Then the yarns are coated with a matrix material which comprises, preferably consists of a mixture comprising

- at least one styrene butadiene random copolymer resin, which may be a carboxylated or a non-carboxylated styrene butadiene random copolymer resin, and
- at least one tackifier in order to bond fibers predominantly within a single fibrous layer to one another and thereby to stabilize the single unidirectional layer with the matrix material. In preferred embodiments of the manufacture of a single unidirectional fibrous layer the yarns may be spread either before or during or after coating with the matrix material. The coating can be achieved e.g. by reverse roll coating, dipping, spraying or by any other technique which is capable to stabilize the single unidirectional fibrous layer, i.e. to adhere the fibers via the matrix material within the unidirectional layer. The matrix-coating may be partly of fully encapsulating the fibers and does not need to be uniform across a cross-section of the unidirectional layer. For example the matrix concentration may be higher on top and bottom of the unidrectional layer than it is towards the core of the unidirectional layer. There may also be more matrix material on top of the unidirectional fibrous layer compared to the bottom of the unidirectional fibrous layer and vice versa. After the unidirectional fibrous layer has been made a cross-linking reaction of the at least one styrene butadiene random copolymer resin, which may be a carboxylated or a non-carboxylated styrene butadiene random copolymer resin, may be performed either by adding a cross-linking agent to said at least one styrene butadiene resin or by the carboxylic groups of adjacent polymer chains of the at least one carboxylated styrene butadiene random copolymer resin as described before.

(2) Manufacture of an adherent cross-ply from at least two unidirectional single fibrous layers: Two unidirectional fibrous layers resulting from step (1) are cross-plied at a cross-plying angle ranging from 0° to 90°, the latter being preferred.

Then, the two cross-plied unidirectional fibrous layers are adhered to one another e.g. by laminating, pressing or by any other procedure which is capable to generate adhesion between the two unidirectional fibrous layers to yield an adherent two-layer cross-ply. For this purpose a temperature range from 50° C. to 225° C., a pressure range from 0.5 to 10 bars and a time range from 5 seconds to 200 seconds may be applied depending e.g. on the tackiness of the applied matrix material and the chosen tackifying agent. Alternatively, more than two unidirectional fibrous layers can be manufactured into an adherent cross-ply. For example four unidirectional fibrous layers may be adhered to one another and the resulting adherent cross-ply may exhibit a sequence of cross-plying angles being e.g. (0 °/90°/0°/90°) or (0°/90°/90°/0° or (90°/0°/0°/90°) or (0°/0°/90°/90°). During the manufacture of the adherent cross-ply a cross-linking reaction of the at least one styrene butadiene random copolymer resin, which may be a carboxylated or a non-carboxylated styrene butadiene random copolymer resin, may be performed either by adding a cross-linking agent to said at least one styrene butadiene random copolymer resin, which may be a carboxylated or a non-carboxylated styrene butadiene random copolymer resin, or by the carboxylic groups of adjacent polymer chains of the at least one carboxylated styrene butadiene random copolymer resin as described before. Within the scope of the process according to the present invention the term "during cross-plying" means at any suitable stage of the cross-plying procedure, e.g. during the laminating procedure or during the pressing procedure.

(3) Manufacture of a consolidated panel and optionally of a hard-ballistic resistant article:

A number of adherent e.g. two-layer cross-plies resulting from step (2) sufficient to withstand the intended ballistic attack is stacked and the resulting stack is consolidated into a panel e.g. with the aid of a press to result in an consolidated panel. The consolidation can take place e.g. by pressing in a isostatic press at temperatures between 60° C. and 300° C., more preferable between 120° C. and 170° C. at a pressure maintained at a value of e.g. 25 bar to 500, preferably from 25 bar to 100 bar for a time being e.g. between 15 minutes and 100 minutes. If a cross-linking agent is present, or if cross-linking shall be performed by carboxylic groups of adjacent polymer chains of the at least one carboxylated styrene butadiene resin the chosen values of temperature, pressure and time should allow for the cross-linking reaction to occur in the desired extent. Optionally, the panel in the press is cooled down to about 50° C., while still under pressure. The resulting consolidated panel exhibits an intended side of ballistic attack and an inner side. The consolidation can be performed using the same or different adherent cross-plies. If different adherent cross-plies are used the adherent cross-plies closer towards the intended side of ballistic attack may include a resin having different mechanical properties, e.g. a different $T_g$, than adherent cross-plies which are farther from the intended side of ballistic attack. In the latter embodiment the harder and stiffer adherent cross-plies, i.e. adherent cross-plies having a styrene butadiene random copolymer resin, which may be a carboxylated or a non-carboxylated styrene butadiene random copolymer resin, with a higher $T_g$, may be placed towards the intended side of ballistic attack, whereas the less harder and more flexible adherent cross-plies, i.e. adherent cross-plies having a styrene butadiene random copolymer resin, which may be a carboxylated or a non-carboxylated styrene butadiene random copolymer resin, with a lower $T_g$, may be placed farther from the intended side of ballistic attack, e.g. on the inner side of the consolidated panel.

(4) In any case the resulting consolidated panel can be used as such as ballistic resistant article or in an optional process step (4) can be joined to a plate of metal or ceramic to yield a hard-ballistic resistant article.

As mentioned before, the styrene butadiene random copolymer resin used in step (1) of the process according to the present invention may be a carboxylated or a non-carboxylated styrene butadiene random copolymer resin.

In a preferred embodiment of the process according to the present invention in step (1) the styrene butadiene random copolymer resin is a carboxylated styrene butadiene random copolymer resin.

In a further preferred embodiment of the process according to the present invention in step (1) the styrene butadiene random copolymer resin is a non-carboxylated styrene butadiene random copolymer resin.

As described above a cross-linking reaction of the at least one styrene butadiene random copolymer resin, which may be a carboxylated or a non-carboxylated styrene butadiene random copolymer resin, may be comprised only in step (1) or only in step (2) or only in step (3) of the process according to the present invention.

However, in a further embodiment of the process according to the present invention the cross-linking reaction can take place in step (1) and in step (2) of the process according to the present invention. In this embodiment a partial cross-linking of the at least one styrene butadiene random copolymer resin, is performed in step (1) and in step (2) the cross-linking is completed.

In still a further embodiment of the process according to the present invention the cross-linking reaction can take place in each of step (1), step (2) and step (3) of the process according to the present invention. In this embodiment a partial cross-linking of the at least one styrene butadiene random copolymer resin, which may be a carboxylated or a non-carboxylated styrene butadiene random copolymer resin, may be performed in step (1), in step (2) the degree of partial cross-linking may be further increased and in step (3) the cross-linking is completed.

The present invention is explained in more detail in the following examples and comparative examples.

Comparative Example 1 a) Manufacture of a Single Unidirectional Fibrous Layer (1L-UD)

Poly(p-phenylene terephthalamide) multifilament yarns (Twaron® type 1000; 3360 dtex f2000; Manufacturer: Teijin Aramid, NL) were taken from a creel and passed through a reed thus aligned substantially parallel to one another. The substantially parallel yarns were coated with a pre-diluted aqueous carboxylated styrene butadiene latex dispersion (Rovene® 4019, solid content=52.0-54.0 wt.-%, viscosity=580 cps (Brookfield, spindle LV-2, 20 rpm, 25° C.); Tg=+14° C., bound styrene=62%; Manufacturer: Mallard Creek Polymers, USA) using a reverse roll coater. The pre-diluted latex dispersion was obtained by diluting Rovene® 4019 to a solid content of 25 wt. % using tap water. The spread and coated yarns were laid up on a silicone coated release paper and dried by passing over a hot-plate set at a temperature of 120° C. resulting in a single unidirectional fibrous layer (1L-UD).

The resin concentration in the 1L-UD was 13±1 wt. % based on the total weight of the 1L-UD, i.e. with respect to the weight of yarn+matrix without moisture, i.e. the weight of the 1L-UD dried to a water content of practically 0 wt. %, that means a water content of well below 0.5 wt. %. The areal density of the poly(p-phenylene terephthalamide) multifilament yarns in the 1L-UD was 110±5 g/m$^2$. The total areal density including equilibrium moisture content of the 1L-UD was 130±10 g/m$^2$ depending on resin loading and equilibrium moisture content.

b1) Manufacture of a Laminated Cross-Ply from Two 1L-UDs

Two 1L-UDs resulting from a) were cross-plied at a cross-plying angle of 90°. The cross-plied 1L-UDs were laminated in a flat belt-laminator having a heating-zone followed by a pressing-zone. In the heating-zone the cross-plied 1L-UDs were heated for 15 seconds in contact with 120° C. hot belts and in the pressing zone the heated cross-plied 1L-UDs were pressed at 3.5 bar calander roll pressure and finally cooled to room temperature by contact with cooled belts resulting in a laminated cross-ply from two 1L-UDs.

b2) Manufacture of a Pressed Cross-Ply from Two 1L-UDs

Two 1L-UDs resulting from a) were cross-plied at a cross-plying angle of 90°, put into a press and pressed at 130° C. and 10 bar for 20 minutes. The two 1L-UDs remained in the press under pressure until the press was cooled down to 50° C. Then the press was opened and a pressed cross-ply from two 1L-UDs was obtained.

c) Adhesion Between the 1L-UDs in the Cross-Plies from b1) and b2)

The adhesion between the 1L-UDs in the cross-plies resulting from b1) and b2) was measured directly as obtained from the respective cross-plying procedure and called adhesion(0). A part of the cross-plies resulting from b1) and b2) were first inserted into a climate chamber at 65° C. and 80% relative humidity for 27 weeks, then taken out of the climate chamber, conditioned at 20° C. and 65% relative humidity for 24 h and finally the adhesion between the 1L-UDs in the cross-plies was measured and called adhesion(27).

To measure the adhesion between the 1L-UDs in the cross-plies resulting from b1) and b2) a sample was cut from the respective cross-ply in a 45° direction with respect to the yarns in both plies. The 45°-direction was chosen to prevent the individual yarns in the plies to be clamped-in by two clamps simultaneously. In this way only the shear stress at the interface between the two UD-layers and the shear stress within the ply were measured, but not the mechanical properties of the yarn. The sample with dimensions 50×200 mm was placed into an Instron tensile tester equipped with flat clamps and a 10 kN load cell. A clamp distance (gauge length) of 100 mm was applied and a stress-strain curve was measured. From this curve the maximum measured load (in N/m)

was taken as a measure for the degree of adhesion between the 1L-UDs in the respective cross-plies.

d) Water Pickup after Water Soak

The water pick of a laminated cross-ply resulting from b1) was measured directly as obtained from the cross-plying procedure.

To measure the water pickup the laminated cross-ply resulting from b1) was first weighted to yield the weight w1 and then soaked in an aqueous solution of 0.3 wt.-% sodium chloride for 24 h at room temperature followed by 15 minute drip dry under ambient temperature and relative humidity, i.e. the cross-ply was hung for 15 minutes under the said conditions. Then the drip dried cross-ply was weighted to yield the weight w2 and the water pick up was calculated according to the equation (1).

$$\text{water pick up}=([w2-w1]/w1)\cdot 100(\%) \quad (1)$$

Comparative Example 2

Comparative example 2 was performed as comparative example 1 but with the difference that Rovene 4176® was applied for the carboxylated styrene butadiene latex dispersion (solid content=48-52 wt.-%, viscosity=300 cps (Brookfield, spindle LV-2, 20 rpm, 25° C.); Tg=−23° C., bound styrene=50%; Manufacturer: Mallard Creek Polymers, USA).

Comparative Example 3

Comparative example 3 was performed as comparative example 1 but with the difference that Prinlin™ B7137 AL was applied for the matrix material. Prinlin™ B7137 AL is an aqueous dispersion of a styrene isoprene styrene block copolymer containing a rosin, i.e. a tackifier (solid content=43 wt.-%, viscosity=250 cps (Brookfield, spindle LV-2, 30 rpm, 23° C.); ratio of styrene:isoprene=14:86; Manufacturer: Henkel, US). The results of adhesion directly after cross-plying (adhesion(0)), after 27 weeks in the climate chamber (adhesion(27)) and adhesion retention are shown in table 1 for the laminated cross-plies and in table 2 for the pressed cross-plies, wherein both in table 1 and table 2 the term "adhesion retention" is calculated by equation (2).

$$\text{adhesion retention}=[\text{adhesion}(27)/\text{adhesion}(0)]\cdot 100(\%) \quad (2)$$

TABLE 1

| | Laminated cross-ply with resin | Adhesion(27) (N/m) | Adhesion retention after 27 weeks (%) |
|---|---|---|---|
| Comparative example 1 | Rovene ® 4019 | 1890 | 98 |
| Comparative example 2 | Rovene ® 4176 | 1620 | 112 |
| Comparative example 3 | Prinlin ™ B7137 AL | 71 | 6 |

TABLE 2

| | Pressed cross-ply with resin | Adhesion(27) (N/m) | Adhesion retention after 27 weeks (%) |
|---|---|---|---|
| Comparative example 1' | Rovene ® 4019 | 36700 | 139 |

TABLE 2-continued

| | Pressed cross-ply with resin | Adhesion(27) (N/m) | Adhesion retention after 27 weeks (%) |
|---|---|---|---|
| Comparative example 2' | Rovene ® 4176 | 26600 | 92 |
| Comparative example 3' | Prinlin ™ B7137 AL | 210 | 5 |

From tables 1 and 2 it can be seen that after 27 weeks in the climate chamber both the laminated and the pressed cross-plies with the carboxylated styrene butadiene resins of the Rovene® types exhibit a considerably higher adhesion than the cross-plies with the respective styrene isoprene styrene resin Prinlin™ B7137 AL. The adhesion retention after 27 weeks in the climate chamber of the cross-plies with the carboxylated styrene butadiene resins of the Rovene® types is at least 92%, whereas the adhesion retention for the cross-plies with the styrene isoprene styrene resin Prinlin™ B7137 AL is <10%.

The above results are quite the more surprising as the Prinlin™ B7137 AL resin contains a tackifier, whereas the Rovenes® 4019 and 4176 are free of tackifier.

Furthermore, the water pickup of a laminated cross-ply with Rovene® 4019 was found to be 8.13% and of a laminated cross-ply Rovene® 4176 7.89%, whereas the water pickup of a laminated cross-ply with Prinlin™ B7137 AL was found to be 22.9%.

Comparative Example 4 a) Manufacture of 8 kg/m$^2$ Pressed Panels

Single unidirectional fabric layers (1L-UDs) were manufactured as described in comparative example 1a). Inter alia that means that Rovene 4019® was used as the carboxylated styrene butadiene latex dispersion. From the 1L-UDs laminated cross-plies were manufactured as described in comparative example 1 b1). The cross-plies were stacked until a panel with an areal density of 8 kg/m$^2$ was obtained. The stacked panel was put into a press and pressed at 150° C. and 50 bar for 20 minutes. The panel remained in the press under pressure until the press was cooled down to 50° C. Then the press was opened and a pressed panel was obtained. In this manner six pressed panels were manufactured.

Three of said pressed panels were directly—i.e. in an unaged state—further processed into three hard-ballistic articles as described below in part b). The other three of said pressed panels were first aged, i.e. stored for 3 months in a climate chamber at 65° C. and at a relative humidity of 80% and then further processed into three hard-ballistic articles as described immediately below in part b).

b) Manufacture of Hard-Ballistic Articles

Each of the pressed panels resulting from a) was joined to a 4 mm thick Secure 500 steel front strike plate (500×500 mm) available from ThyssenKrupp Steel, DE. The areal density of the steel plate was 32 kg/m$^2$. For the joining operation the joining side of the panel was coated with Sika® 209 as primer and then both the steel plate and the joining side of the panel were coated with Sikaflex® 228 both available from SIKA Deutschland GmbH, DE.

c) v50 Measurement of the Hard-Ballistic Articles and Delamination Behaviour

The hard-ballistic articles resulting from b) were evaluated for their anti-ballistic capability by measuring v50, i.e. the velocity in m/s, at which 50% of the projectiles were stopped. The projectiles used were NIJ level 3 threat 7.62×51 mm soft-core (NATO M80 ball) 0° obliquity. The evaluation of v50 is described e.g. in MIL STD 662F.

Furthermore, the delamination behaviour of the 1L-UDs in the pressed panel behind the steel plate was evaluated by visual inspection. "Minimal delamination" means that less than 3% of the 1L-UD layers in the pressed panel were delaminated. "Light delamination" means that less than 5% of the 1L-UD layers in the pressed panel were delaminated. "Interior delamination" means that more than 30% of the 1L-UD layers in the pressed panel were delaminated. "Very strong interior delamination" means that more than 70% of the 1L-UD layers in the pressed panel were delaminated.

Both interior delamination and even more very strong interior delamination will have a drastic negative effect on the multihit capability of the anti-ballistic article.

Example 1

Example 1 was performed as comparative example 4 but with the difference that the used dispersion to build the matrix material was a mixture of 90 wt.-% of the carboxylated styrene butadiene random copolymer Rovene® 4019 and 10 wt.-% Aquatac® 6025. Aquatac® 6025 is a waterborne dispersion containing about 58 wt.-% rosin ester as a takifier, about 39 wt.-% water, and less than 4 wt.-% surfactant. The results are shown in table 4.

Comparative Example 5

Comparative example 5 was performed as comparative example 4 but with the difference that Rovene 4176® was used as the carboxylated styrene butadiene latex dispersion. The results are shown in table 4.

Comparative Example 6

Comparative example 6 was performed as comparative example 4 but with the difference that Prinlin™ B7137 AL was applied for the matrix material. The results are shown in table 4.

TABLE 4

| | Hard-ballistic article (8 kg/m$^2$ pressed panel behind a steel front strike plate) with resin | $v_{50}$ (m/s) unaged | Delamination unaged | $v_{50}$ (m/s) aged | Delamination aged |
|---|---|---|---|---|---|
| Comparative example 4 | Rovene ® 4019 | 821 | Light | 834 | Light |
| Example 1 | 90 wt.-% Rovene ® 4019<br>10 wt.-% Aquatac ® 6025 | 816 | Minimal | — | — |
| Comparative example 5 | Rovene ® 4176 | 832 | Light | — | — |
| Comparative example 6 | Prinlin ™ B7137 AL | 830 | interior delamination | 834 | Very strong interior delamination |

Table 4 shows that in the unaged state the v50-values of the inventive hard-ballistic article according to example 1 with 90 wt.-% of the carboxylated styrene butadiene random copolymer resin Rovene® 4019 and 10 wt.-% of the tackifier Aquatac® 6025 exhibits only minimal structural delamination. This means that less than 3% of the 1L-UD layers in the pressed panels of the inventive hard-ballistic article are delaminated. Said surprisingly high structural integrity is achieved together with a v50-value of 816 m/s which is practical identical with the v50-values measured with the comparative hard-ballistic articles according to comparative examples 4, 5 and 6 within the experimental error of the v50-determination the maximal error range of which amounts to about ±15 m/s.

Compared with the inventive hard-ballistic article according to example 1 the comparative hard-ballistic articles according to comparative examples 4, 5 and 6 exhibit a lower structural integrity:

- The hard-ballistic articles of comparative examples 4 and 5 with only the carboxylated styrene butadiene random copolymer resin Rovene® 4019 and Rovene® 4176, respectively but with no tackifier in the matrix material exhibit light structural delamination. This means that less than 5% of the 1L-UD layers in the pressed panels of said comparative hard-ballistic articles are delaminated.
- The hard-ballistic article of comparative example 6 with the matrix material Prinlin™ B7137 AL containing a styrene isoprene styrene block-copolymer and the tackifier abietic acid exhibits
- in the unaged state interior delamination, i.e. more than 30% of the 1L-UD layers in the pressed panels of said comparative hard-ballistic article are delaminated, and
- in the aged state even very strong interior delamination, i.e. more than 70% of the 1L-UD layers in the pressed panels of said comparative hard-ballistic article are delaminated.

Comparative Example 7

Four pressed panels each of them exhibiting an areal density of 8 kg/m$^2$ were manufactured as in comparative example 5, i.e. with Rovene® 4176. Said panels were aged, i.e. stored for 3 months in a climate chamber at 65° C. and at a relative humidity of 80%.

The aged panels were joined to a 7 mm thick ALOTEC® 96 SB ceramic front plate (500×500 mm) obtainable from Etec Gesellschaft für Technische Keramik GmbH, DE, to produce three hard-ballistic articles. The areal density of the ceramic plate was 26.3 kg/m$^2$. For the joining operation both the ceramic plate and the joining side of the panel were coated with Sika® 209 as primer and then both with Biresin® U-1305. Both Sika® 209 and Biresin® U-1305 are available from SIKA Deutschland GmbH, DE.

The resulting four hard-ballistic articles were evaluated for their anti-ballistic capability by measuring v50 as described in comparative example 4c) resulting in v50=956 m/s and light deformation of the 1L-UDs in the pressed panel behind the ceramic plate, i.e. less than 5% of the 1L-UD layers in the pressed panels of said comparative hard-ballistic article are delaminated.

Example 2

Example 2 was conducted as comparative example 1 with the only difference that a mixture of 90 wt.-% Rovene® 4019 and 10 wt.-% Aquatac® 6025 was used for the matrix material resulting in an inventive hard-ballistic article exhibiting a v50-value of 850 m/s together with minimal deformation, i.e. less than 3% of the 1L-UD layers in the pressed panels of said inventive hard-ballistic article are delaminated.

Comparative Example 8 a) Manufacture of a Single Unidirectional Fibrous Layer (1L-UD)

Poly(p-phenylene terephthalamide) multifilament yarns (Twaron® type 1000; 3360 dtex f2000; Manufacturer: Teijin Aramid, NL) were taken from a creel and passed through a reed thus aligned substantially parallel to one another. The substantially parallel yarns were dipped in a bath containing a resin emulsion. The resin emulsion consisted of a mixture of 40 wt. % Rovene® 4176 (Tg=−23° C.; pH=9 to 10) and 60 wt. % Rovene® 4220 having a Tg of −26° C. and a pH of 11 to 12 (Manufacturer: Mallard Creek Polymers, USA). Rovene® 4220 is a non-carboxylated styrene butadiene rubber, i.e. it does not contain carboxlic acid groups. After leaving the bath the dipped yarns were passed through nip rollers and spread. The spread yarns coated with the emulsion were laid up on a silicone coated release liner and then dried using an oven set at 120° C. for 2 to 4 minutes resulting in a single unidirectional fabric layer (1L-UD).

The resin concentration in the 1L-UD was in the range of 15.5 to 19 wt. % based on the total weight of the 1L-UD, i.e. with respect to the weight of yarn+matrix. The areal density of the poly(p-phenylene terephthalamide) multifilament yarns in the 1L-UD was 110±5 g/m$^2$. The total areal density of the 1L-UD was in the range of 121 to 137 g/m$^2$.

b) Manufacture of a Laminated Cross-Ply from Two 1L-UDs

Two 1L-UDs resulting from a) were cross-plied at cross-plying angle of 90°±5°. The cross-plied 1L-UDs were laminated in a cross-plying unit using a multi step process. In the first step, the cross-plied 1L-UDs were heated for 5 to 15 seconds in close contact with a 92.5° C. hot platen without applying any pressure. Then a pressure of around 1.1 bar was applied for 5 to 15 seconds and finally cooled to room temperature by ambient air resulting in a laminated cross-ply from two 1L-UDs.

c) Manufacture of 19.5 kg/m$^2$ Pressed Panels

A laminated cross-ply resulting from b) was stacked until a panel with dimensions 381×381 mm with an areal density of 19.5 kg/m$^2$ was obtained. The stacked panel was transferred into a press and pressed for 30 minutes at a temperature of 135° C. under a pressure of 30 bars. The panel remained in the press under pressure until the press was cooled down to 30° C. Then the press was opened and a pressed panel was obtained.

d) v50 Measurement of the Hard-Ballistic Articles and Delamination Behaviour

The pressed panel resulting from c) was evaluated for its antiballistic capability by measuring v50 using a 30 cal FSP threat (as per MIL-P-46593A) weighting 2.851 g.

Furthermore, the delamination behaviour of the pressed panel was evaluated by visual inspection.

The results are shown in table 5.

Example 3

Example 3 was performed as comparative example 8 with the difference that in step a) an emulsion was used consisting of 90 wt. % Rovene® 4176 (Tg=−23° C., pH=9 to 10) and 10 wt. % of the tackifier Aquatac® 6025 (Manufacturer: Arizona Chemicals (US)). The areal density of the poly(p-phenylene terephthalamide) multifilament yarns in the 1L-UD was 110±5 g/m$^2$. The resin concentration in the 1L-UD was in the range of 15.5 to 19 wt. % based on the total weight of the 1L-UD, i.e. with respect to the weight of yarn+matrix. The total areal density of the 1L-UD was in the range of 121 to 127 g/m$^2$. The results are shown in table 5.

Comparative Example 9

Comparative example 9 was performed as comparative example 8 with the difference that in step a) an emulsion was used consisting of 100 wt. % BARRIER PRO/Rovene® 4560-3-1 having a Tg of −17° C. and a pH of 8 to 9 (Manufacturer: Mallard Creek Polymers (US)). BARRIER PRO/Rovene® 4560-3-1 is an anionic carboxylated styrene butadiene copolymer latex containing a non-staining antioxidant. The areal density of the poly(p-phenylene terephthalamide) multifilament yarns in the 1L-UD was 110±5 g/m$^2$. The resin concentration in the 1L-UD was in the range of 15.5 to 19 wt. % based on the total weight of the 1L-UD, i.e. with respect to the weight of yarn+matrix. The total areal density of the 1L-UD was in the range of 121 to 127 g/m$^2$.

The results are shown in table 5.

Example 4

Example 4 was performed as comparative example 8 with the difference that in step a) an emulsion was used consisting of 90 wt. % Rovene® 4019 (Tg=+14° C.; pH=7 to 8) and 10 wt. % of the tackifier Aquatac® 6025 (Tg around 25° C.). The areal density of the poly(p-phenylene terephthalamide) multifilament yarns in the 1L-UD was 110±5 g/m$^2$. The resin concentration in the 1L-UD was in the range of 15.5 to 19 wt. % based on the total weight of the 1L-UD, i.e. with respect to the weight of yarn+matrix. The total areal density of the 1L-UD was in the range of 121 to 127 g/m$^2$. The resin concentration in the 1L-UD was in the range of 15.5 to 19 wt. % based on the total weight of the 1L-UD, i.e. with respect to the weight of yarn+matrix. The total areal density of the 1L-UD was in the range of 121 to 127 g/m$^2$.

The results are shown in table 5.

Example 5

Example 5 was performed as comparative example 8 with the difference that in step a) an emulsion was used consisting of 90 wt. % Rovene® 4019 (Tg=+14° C.; pH=7 to 8), 5 wt. % of the tackifier Aquatac® 6025 (Tg around 25° C.) and 5 wt. % of the tackifier Aquatec® 6085 (Tg around 85° C.). The areal density of the poly(p-phenylene terephthalamide) multifilament yarns in the 1L-UD was 110±5 g/m$^2$. The resin concentration in the 1L-UD was in the range of 15.5 to 19 wt. % based on the total weight of the 1L-UD, i.e. with respect to the weight of yarn+matrix. The total areal density of the 1L-UD was in the range of 121 to 127 g/m$^2$.

The results are shown in table 5.

Comparative Example 10

Comparative example 10 was performed as comparative example 8 with the difference that in step a) an emulsion was used consisting of 60 wt. % BARRIER PRO/Rovene® 4560-3-1 (Tg=−17° C.; pH=8 to 9) and 40 wt. % Rovene® 4019 (Tg=+14° C.; pH=7 to 8). The areal density of the poly(p-phenylene terephthalamide) multifilament yarns in the 1L-UD was 110±5 g/m$^2$. The resin concentration in the 1L-UD was in the range of 15.5 to 19 wt. % based on the total weight of the 1L-UD, i.e. with respect to the weight of yarn+matrix. The total areal density of the 1L-UD was in the range of 121 to 127 g/m$^2$.

The results are shown in table 5.

Comparative Example 11

Comparative example 11 was performed as comparative example 8 with the difference that in step a) an emulsion was used consisting of 40 wt. % Rovene® 4176 ($T_g$=−23° C.; pH=9 to 10) and 60 wt. % BARRIER PRO/Rovene® 4560-3-1 ($T_g$=−17° C.; pH=8 to 9). The areal density of the poly (p-phenylene terephthalamide) multifilament yarns in the 1L-UD was 110±5 g/m$^2$. The resin concentration in the 1L-UD was in the range of 15.5 to 19 wt. % based on the total weight of the 1L-UD, i.e. with respect to the weight of yarn+matrix. The total areal density of the 1L-UD was in the range of 121 to 127 g/m$^2$.

The results are shown in table 5.

Comparative Example 12

Comparative example 12 was performed as comparative example 8 with the difference that in step a) an emulsion was used consisting of 40 wt. % Rovene® 4220 ($T_g$=−26° C.; pH=11 to 12) and 60 wt. % Rovene® 4019 ($T_g$=+14° C.; pH=7 to 8). Rovene® 4220 is a non-carboxylated styrene butadiene resin. The areal density of the poly(p-phenylene terephthalamide) multifilament yarns in the 1L-UD was 110±5 g/m$^2$. The resin concentration in the 1L-UD was in the range of 15.5 to 19 wt. % based on the total weight of the 1L-UD, i.e. with respect to the weight of yarn+matrix. The total areal density of the 1L-UD was in the range of 121 to 127 g/m$^2$. The results are shown in table 5.

Example 6

Example 6 was performed as comparative example 8 with the difference that in step a) an emulsion was used consisting of 97 wt. % Rovene® 4176 ($T_g$=−23° C.; pH=9 to 10) and 3 wt. % of the tackifier Aquatac® 6025 ($T_g$ around 25° C.). The areal density of the poly(p-phenylene terephthalamide) multifilament yarns in the 1L-UD was 110±5 g/m$^2$. The resin concentration in the 1L-UD was in the range of 15.5 to 19 wt. % based on the total weight of the 1L-UD, i.e. with respect to the weight of yarn+matrix. The total areal density of the 1L-UD was in the range of 121 to 127 g/m$^2$.

The results are shown in table 5.

Example 7

Example 7 was performed as comparative example 8 with the difference that in step a) an emulsion was used consisting of 97 wt. % Rovene® 4019 ($T_g$=+14° C.; pH=7 to 8) and 3 wt. % of the tackifier Aquatac® 6025 ($T_g$ around 25° C.). The areal density of the poly(p-phenylene terephthalamide) multifilament yarns in the 1L-UD was 110±5 g/m$^2$. The resin concentration in the 1L-UD was in the range of 15.5 to 19 wt. % based on the total weight of the 1L-UD, i.e. with respect to the weight of yarn+matrix. The total areal density of the 1L-UD was in the range of 121 to 127 g/m$^2$. The results are shown in table 5.

Comparative Example 13

Comparative example 13 was performed as comparative example 8 with the difference that in step a) an emulsion was used consisting of 100 wt. % Prinlin™ B7137 HV, i.e. a dispersion of a styrene isoprene styrene block-copolymer containing abietic acid as tackifier. The areal density of the poly(p-phenylene terephthalamide) multifilament yarns in the 1L-UD was 110±5 g/m$^2$. The resin concentration in the 1L-UD was in the range of 15.5 to 19 wt. % based on the total weight of the 1L-UD, i.e. with respect to the weight of yarn+matrix. The total areal density of the 1L-UD was in the range of 121 to 127 g/m$^2$. The results are shown in table 5.

TABLE 5

| | Resin | $v_{50}$ (m/s) | Delamination |
|---|---|---|---|
| Comparative example 8 | 40 wt. % Rovene ® 4176<br>60 wt. % Rovene ® 4220 | 820 ± 25 | Light to medium bulging |
| Example 3 | 90 wt. % Rovene ® 4176<br>10 wt. % Aquatac ® 6025 | 830 ± 30 | Light to medium bulging |
| Comparative example 9 | 100 wt. % BARRIER PRO/Rovene ® 4560-3-1 | 810 ± 30 | Light bulging with local delamination |
| Example 4 | 90 wt. % Rovene ® 4019<br>10 wt. % Aquatac ® 6025 | 720 ± 25 | Very light to no bulging |
| Example 5 | 90 wt. % Rovene ® 4019<br>5 wt. % Aquatac ® 6025<br>5 wt. % Aquatac ® 6085 | 700 ± 25 | Very light to no bulging |
| Comparative example 10 | 60 wt. % BARRIER PRO/Rovene ® 4560-3-1<br>40 wt-% Rovene ® 4019 | 760 ± 25 | Very light to no bulging |
| Comparative example 11 | 40 wt. % Rovene ® 4176<br>60 wt. % BARRIER PRO/Rovene ® 4560-3-1 | — | Light bulging |
| Comparative example 12 | 40 wt. % Rovene ® 4220<br>60 wt. % Rovene ® 4019 | — | Light bulging |
| Example 6 | 97 wt. % Rovene ® 4176<br>3 wt. % Aquatac ® 6025 | 830 ± 20 | Light bulging |
| Example 7 | 97 wt. % Rovene ® 4019<br>3 wt. % Aquatac ® 6025 | 720 ± 25 | Very light to no bulging |
| Comparative example 13 | 100 wt. % Prinlin ™ B7137 HV | 885 ± 25 | Very strong delamination |

The comparison of example 3 with example 7 in table 5 shows that it is possible to manufacture a ballistic resistant article exhibiting very light to even no bulging by substituting only 3 wt.-% of the carboxylated styrene butadiene random copolymer Rovene® 4176 by 3 wt.-% of the tackifier Aquatac® 6025 in order to provide the matrix material for the ballistic resistant article.

Comparative Example 14 a) Manufacture of a Two-Ply Composite

A fabric having the construction
plain weave, 1×1,
poly(p-phenylene terephthalamid) multifilament yarns (Twaron® 2040 1100 dtex),
31×31 (31 yarns per inch both in warp and in weft), and
an areal density of 289 g/m$^2$ was used.

From said fabric a fabric piece of 1 inch×8 inch (2.54 cm×20.32 cm) was cut. The fabric piece was placed on paper and the top section of the fabric piece width was taped with a 0.25 to 0.5 inch margin.

2-3 ml of an aqueous carboxylated styrene butadiene latex dispersion (Rovene® 4176, solid content 48-52.0 wt.-%, viscosity=300 cps (Brookfied, spindle LV-2, 20 rpm, 25° C.), $T_g$=−23° C., bound styrene=50%, Manufacturer: Mallard Creek Polymers, USA) were slowly dispensed besides the tape. Then the dispersion was drawn down by using a 14 Meyer rod to apply a thin coating on the fabric. Then another 2-3 ml of Rovene® 4019 were slowly dispensed besides the tape and drawn down by using a 14 Meyer rod resulting in a coated fabric piece. In this manner two coated fabric pieces were prepared.

Said two coated fabric pieces were placed with the coated side faces to each other, heat consolidated at a temperature of 131° C., a pressure of 4.9 bar for 1 minute and allowed to cool down to room temperature to result in a two ply composite having an areal density of 649 g/m$^2$ and the weight percentage of the resin was 12 wt.-%.

In the manner described above 6 two-ply composites were manufactured. 3 of said composites were stored at room temperature (20° C.) in air at normal pressure.

b) Accelerated Aging 3 of said composites were subjected to accelerated chemical and thermal aging according to ASTM D572-04 at 70° C., 300 psi (20.7 bar) in 99.7% oxygen for a duration of 5 days and 10 days.

c) Adhesion Between the Woven Fabrics in the Two Ply Composites

The adhesion between the woven fabrics in the two ply composites in the unaged and in the aged state, respectively was measured according to ASTM 1876-00. and is given in units of gram-force (1 gram-force=9.807 mN) as an arithmetical average of the respective 3 composites together with the standard deviation.

To measure the adhesion, a ½ inch section of the laminate along the length direction is separated. Once the two layers have been separated, the test specimen is loaded into the clamps of the testing apparatus so that one layer material is between each clamp. The laminate is centered on the clamp faces. Next the peel load at constant head speed of 10 inch/minute to an extension of 6 inches is applied. The reported adhesion value is the average value based on 5 peaks and 5 troughs.

The two-ply composites each having an areal density of 649 g/m$^2$ exhibited adhesion results shown in table 6.

Example 8

Example 8 was conducted as comparative example 14 with the only difference that in step a) a mixture of 95 wt.-% Rovene® 4176 and 5 wt.-% Aquatac® 6025 was used. Aquatac® 6025 is a waterborne dispersion containing about 58 wt. % rosin ester, about 39 wt.-% water and less than 4 wt.-% surfactant. The resulting two-ply composites had an areal density of 649 g/m$^2$ and the weight percentage of the matrix material was 12 wt.-%. The adhesion results are shown in table 6.

Example 9

Example 9 was conducted as example 8 with the only difference that in step a) a mixture of 90 wt.-% Rovene® 4176 and 10 wt.-% Aquatac® 6025 was used. The resulting two ply composites had an areal density of 649 g/m$^2$ and the weight percentage of the matrix material was 12 wt.-%. The adhesion results are shown in table 6.

Comparative Example 15

Comparative example 15 was conducted as comparative example 14 with the only difference that in step a) Rovene® 4220 was used. Rovene® 4220 is a non-carboxylated styrene butadiene rubber having a $T_g$ of −26° C. and is delivered as an emulsion having a pH of 11-12. The resulting two ply composites had an areal density of 649 g/m$^2$ and the weight percentage of the matrix material was 12 wt.-%. The adhesion results are shown in table 6.

Example 10

Example 10 was conducted as comparative example 15 with the only difference that in step a) a mixture of 95 wt.-% Rovene® 4220 and 5 wt.-% Aquatac® 6025 was used. The resulting two ply composites had an areal density of 649 g/m$^2$ and the weight percentage of the matrix material was 12 wt.-%. The adhesion results are shown in table 6.

Example 11

Example 11 was conducted as example 10 with the only difference that in step a) a mixture of 90 wt.-% Rovene® 4220 and 10 wt.-% Aquatac® 6025 was used. The resulting two ply composites had an areal density of 649 g/m$^2$ and the weight percentage of the matrix material was 12 wt.-%. The adhesion results are shown in table 6.

TABLE 6

| | Resin | Adhesion after 5 d at 20° C., air, normal pressure [gram-force] | Adhesion after 5 d at 70° C., 99.7% $O_2$, 20.7 bar [gram-force] | Adhesion after 10 d at 20° C., air, normal pressure [gram-force] | Adhesion after 10 d at 70° C., 99.7% $O_2$, 20.7 bar [gram-force] |
|---|---|---|---|---|---|
| Comparative example 14 | 100 wt. % Rovene ® 4176 | 2113 ± 918 | 1943 ± 974 | 3430 ± 650 | 3567 ± 472 |
| Example 8 | 95 wt. % Rovene ® 4176 5 wt.-% Aquatac ® 6025 | 3280 ± 207 | 3180 ± 167 | 2875 ± 488 | 3415 ± 827 |

TABLE 6-continued

| | Resin | Adhesion after 5 d at 20° C., air, normal pressure [gram-force] | Adhesion after 5 d at 70° C., 99.7% $O_2$, 20.7 bar [gram-force] | Adhesion after 10 d at 20° C., air, normal pressure [gram-force] | Adhesion after 10 d at 70° C., 99.7% $O_2$, 20.7 bar [gram-force] |
|---|---|---|---|---|---|
| Example 9 | 90 wt. % Rovene ® 4176 10 wt.-% Aquatac ® 6025 | 4577 ± 1060 | 4553 ± 1499 | 3765 ± 757 | 4815 ± 163 |
| Comparative example 15 | 100 wt. % Rovene ® 4220 | 800 ± 173 | 792 ± 50 | 1317 ± 449 | 1120 ± 168 |
| Example 10 | 95 wt. % Rovene ® 4220 5 wt.-% Aquatac ® 6025 | 2740 ± 339 | 2025 ± 785 | 1825 ± 728 | 1650 ± 778 |
| Example 11 | 90 wt. % Rovene ® 4220 10 wt.-% Aquatac ® 6025 | 1987 ± 311 | 1427 ± 618 | 1293 ± 293 | 1916 ± 488 |

The results shown in table 6 can be summarized as follows.

1. Composites with the Carboxylated Styrene Butadiene Random Copolymer Resin Rovene® 4176 with or without the Tackifier Aquatac® 6025

1.1 Adhesion after 5 Days

Comparison of comparative example 14 with examples 8 and 9 shows that after 5 days at 20° C. in air at normal pressure the adhesion between the woven fabrics increases, if the tackifier Aquatac® 6025 is added to the carboxylated styrene butadiene random copolymer Rovene® 4176.

Comparison of comparative example 14 with examples 8 and 9 shows that after 5 days at 70° C. in $O_2$ at 20.7 bar the adhesion between the woven fabrics increases, if the tackifier Aquatac® 6025 is added to the carboxylated styrene butadiene random copolymer Rovene® 4176. Comparison of the adhesion values of the unaged composites with the aged composites shows that

- without takifier the aging resulted in a decrease of adhesion from 2113 to 1943 [gram-force], i.e. to a 8% decrease in adhesion (see comparative example 14),
- with 5 wt.-% takifier the aging resulted in a decrease of adhesion from 3280 to 3180 [gram-force], i.e. only to a 3% decrease in adhesion (see example 8), and
- with 10 wt.-% takifier the aging resulted in a decrease of adhesion from 4577 to 4553 [gram-force], i.e. only to a 0.5% decrease in adhesion (see example 9).

1.2 Adhesion after 10 Days

Comparison of the adhesion values after 10 days in comparative example 14 of the aged samples with the unaged samples show an increase of adhesion from 3430 to 3567 [g-force], i.e. an increase in adhesion of 4%.

Comparison of the adhesion values after 10 days in example 8 of the aged samples with the unaged samples show an increase of adhesion from 2875 to 3415 [g-force], i.e. an increase in adhesion of 19%.

Comparison of the adhesion values after 10 days in example 9 of the aged samples with the unaged samples show an increase of adhesion from 3765 to 4815 [g-force], i.e. an increase in adhesion of 28%.

2. Composites with the Non-Carboxylated Styrene Butadiene Random Copolymer Resin Rovene® 4220 with or without the Tackifier Aquatac® 6025

Comparison of examples 10 and 11 with comparative example 15 shows that the substitution of 5 or 10 wt.-% of the non-carboxylated styrene butadiene random copolymer resin Rovene 4220 by 5 or 10 wt.-% of the tackifier Aquatac® 6025 tends to increases the adhesion of the woven fabrics in the two-ply composites.

The invention claimed is:

1. A ballistic resistant article comprising a plurality of fibrous layers, each of said layers comprising a network of fibers, wherein the fibers have a strength of at least 800 mN/tex (1100 MPa) according to ASTM D 7269-07 and a matrix material, wherein the matrix material comprises a mixture comprising at least one styrene butadiene random copolymer resin, and at least one tackifier.

2. The ballistic resistant article according to claim 1, wherein the styrene butadiene random copolymer resin is a carboxylated styrene butadiene random copolymer resin.

3. The ballistic resistant article according to claim 1, wherein the styrene butadiene random copolymer resin is a non-carboxylated styrene butadiene random copolymer resin.

4. The ballistic resistant article according to claim 1, wherein the tackifier is selected from the group consisting of rosin resins or terpene resins or hydrocarbon resins.

5. The ballistic resistant article according to claim 1, wherein the tackifier is present in the matrix material in a weight percentage with respect to the weight of the matrix material ranging from 1 wt. % to 20 wt. %.

6. The ballistic resistant article according to claim 5, wherein the at least one tackifier is present in the matrix material in the weight percentage with respect to the weight of the matrix material ranging from 1 wt. % to 20 wt. % to reduce water pickup in comparison to a ballistic resistant article of the same construction but without the tackifier.

7. The ballistic resistant article according to claim 5, wherein the at least one tackifier is present in the matrix material in the weight percentage with respect to the weight of the matrix material ranging from 1 wt. % to 20 wt. % to reduce delamination of the plurality of fibrous layers upon ballistic attack in comparison to a ballistic resistant article of the same construction but without the tackifier.

8. The ballistic resistant article according to claim 1, wherein the network of fibers is a unidirectional alignment of the fibers.

9. The ballistic resistant article according to claim 1, wherein the fibers are aramid fibers.

10. The ballistic resistant article according to claim 1, wherein the fibers have a weight wf, the matrix material has a weight wm and a weight percentage of the matrix material with respect to (wf+wm) is from 5 wt. % to 50 wt. %.

11. The ballistic resistant article according article to claim 1, wherein the areal density of the fibers in a single fibrous layer ranges from 10 $g/m^2$ to 250 $g/m^2$.

12. The ballistic resistant article according to claim 1, wherein the total areal density of a single fibrous layer ranges from 11 $g/m^2$ to 350 $g/m^2$.

13. The ballistic resistant article according to claim 1, wherein the plurality of fibrous layers is formed into a panel and the panel is joined to a plate of metal or ceramic.

14. Ballistic resistant article according to claim 1, wherein a scrim comprising a thermoplastic material is situated between the fibrous layers.

15. A process to manufacture a ballistic resistant article comprising the steps:

(1) Manufacture of a single unidirectional fibrous layer, each of said layers comprising a network of fibers, wherein the fibers have a strength of at least 800 mN/tex (1100 MPa) according to ASTM D 7269-07, and comprising a matrix material, which comprises a mixture comprising at least one styrene butadiene random copolymer resin, and at least one tackifier, (2) manufacture of an adherent cross-ply from at least two unidirectional single fibrous layers resulting from step (1), (3) manufacture of a consolidated panel from a number of adherent cross-plies resulting from step (2), and optionally (4) joining of the consolidated panel resulting from step (3) to a plate of metal or ceramic to yield a hard-ballistic resistant article.

16. The process according to claim 15, wherein in step (1) the styrene butadiene random copolymer resin is a non-carboxylated styrene butadiene random copolymer resin.

17. The process according to claim 15, wherein in step (1) the styrene butadiene random copolymer resin is a carboxylated styrene butadiene random copolymer resin.

18. The process according to claim 15, wherein a cross-linking reaction of the at least one styrene butadiene random copolymer resin is comprised in at least one of the steps (1), (2) and (3).

* * * * *